US006289685B1

(12) United States Patent
Utsumi et al.

(10) Patent No.: US 6,289,685 B1
(45) Date of Patent: Sep. 18, 2001

(54) AIR CONDITIONER WITH COMBUSTION HEATER FOR REFRIGERANT

(75) Inventors: Masato Utsumi; Katsuhiro Kawabata; Keisuke Tanimoto, all of Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/295,606

(22) Filed: Apr. 22, 1999

(51) Int. Cl.[7] ..... F25B 29/00

(52) U.S. Cl. ..... 62/238.6; 62/238.7; 62/160; 237/2 B; 165/240; 126/99 R; 126/116 R

(58) Field of Search ..... 165/240, 241, 165/242, 168; 126/116 R, 99 R; 62/238.6, 238.7, 160; 237/2 B

(56) References Cited

U.S. PATENT DOCUMENTS

| | | | | |
|---|---|---|---|---|
| 4,191,023 | * | 3/1980 | Sisk et al. | 165/240 |
| 4,493,193 | * | 1/1985 | Fisher et al. | 62/238.7 |
| 4,802,529 | * | 2/1989 | Sumitani et al. | 165/240 |
| 5,189,887 | * | 3/1993 | Vandervaart | 165/240 |
| 5,343,935 | * | 9/1994 | Sumitani | 165/240 |

FOREIGN PATENT DOCUMENTS

| | | | | |
|---|---|---|---|---|
| 2946698 | * | 5/1981 | (DE) | 62/238.6 |
| 3638194 | * | 5/1987 | (DE) | 62/238.7 |
| 0006412 | * | 1/1980 | (EP) | 62/238.6 |
| 2223838 | * | 4/1990 | (GB) | 165/168 |
| 55-9618 | | 3/1980 | (JP) . | |
| 0173054 | * | 8/1986 | (JP) | 62/238.7 |
| 1-169270 | * | 7/1989 | (JP) | 165/168 |
| 0171557 | * | 7/1990 | (JP) | 62/238.7 |

OTHER PUBLICATIONS

English "Summary" of Japanese Patent Publication Gazette No. 55–9618, of approximately 250 words, (No Date).

* cited by examiner

*Primary Examiner*—John K. Ford
(74) *Attorney, Agent, or Firm*—Nixon Peabody LLP; Donald R. Studebaker

(57) ABSTRACT

A compressor, an outdoor heat exchanger, an indoor heat exchanger, and the like are connected to each other with refrigerant piping to form a refrigerant circuit in a closed loop configuration. The refrigerant circuit is provided with a four-way switch valve such that the direction of circulation of a refrigerant is reversible. The refrigerant circuit is provided with a refrigerant heater. During a cooling operation, an electromagnetic valve is closed so that the outdoor heat exchanger serves as a condenser to perform a refrigeration cycle operation. During a heating operation, natural gas is caused to burn in the refrigerant heater to heat and evaporate the refrigerant with high-temperature combustion gas. The evaporated refrigerant flows into the indoor heat exchanger, exchanges heat with indoor air, and is condensed, whereby the indoor air is heated.

2 Claims, 8 Drawing Sheets

AIR CONDITIONER WITH COMBUSTION HEATER FOR REFRIGERANT

FIELD OF THE INVENTION

The present invention relates to an air conditioner comprising a refrigerant circuit for performing a refrigeration cycle.

BACKGROUND OF THE INVENTION

There has conventionally been known an air conditioner comprising a refrigerant circuit and a refrigerant heating device for heating a refrigerant with warm water from a boiler (see, for example, Japanese Examined Patent Publication No. SHO 55-9618).

Specifically, the refrigerant circuit is composed of a compressor, an outdoor heat exchanger, an expansion mechanism, and an indoor heat exchanger which are connected to each other with piping. The refrigerant circuit has the refrigerant circulating through the inside thereof and a four-way switch valve such that the direction of circulation of the refrigerant is reversible. The air conditioner performs a cooling operation using a refrigeration cycle operation and a heating operation using a heat pump cycle operation. The air conditioner also performs a heating operation by supplying the refrigerant heated by the refrigerant heating device to the indoor heat exchanger. In short, the air conditioner performs both of the heating operation using the heat pump cycle operation and the heating operation using the refrigerant heating device.

On the other hand, the refrigerant heating device heats the refrigerant with warm water from a boiler. Specifically, the refrigerant heating device introduces the warm water generated by the boiler into a warm water tank and causes a heat exchange between the warm water in the warm water tank and the refrigerant. In short, the refrigerant heating device heats the refrigerant by using the sensible heat change of the warm water.

The air conditioner switches between the refrigeration cycle operation and the heat pump cycle operation. The outdoor heat exchanger of the refrigerant circuit functions as a condenser during the refrigeration cycle operation, while functioning as an evaporator during the heat pump cycle operation. Therefore, the specifications of the outdoor heat exchanger should be determined such that the outdoor heat exchanger exerts sufficient abilities as the condenser during the cooling operation and as the evaporator during the heating operation.

However, the optimum specifications for a condenser are different from the optimum specifications for an evaporator. Consequently, such a problem has been encountered that the outdoor heat exchanger optimized as an evaporator has an excessive ability as a condenser. Briefly, the specifications of the outdoor heat exchanger cannot be optimized as both the condenser and the evaporator. The problem leads to another problem that the operating conditions cannot be optimized during both the refrigeration cycle operation and the heat pump cycle operation, resulting in a reduction in energy efficiency.

The present invention has been achieved in view of the foregoing. It is therefore an object of the present invention to improve energy efficiency in an air conditioner comprising a refrigerant circuit.

SUMMARY OF THE INVENTION

The present invention provides an air conditioner with specified heating means.

Specifically, the air conditioner according to the present invention comprises a refrigerant circuit having a refrigerant circulating through the inside thereof, the refrigerant circuit comprising a heat-use-side heat exchanger for causing a heat exchange between the refrigerant and indoor air, a condenser only for condensing the refrigerant by causing a heat exchange between the refrigerant and outdoor air, and heating means only for heating the refrigerant.

In the air conditioner, a circulating operation in a refrigeration cycle is performed in the refrigerant circuit during a cooling operation. In this case, the heat exchange is caused between the refrigerant and the indoor air in the heat-use-side heat exchanger so that the refrigerant absorbs heat to be evaporated, while the indoor air is cooled. The refrigerant that has absorbed heat in the heat-use-side heat exchanger flows to the condenser. The condenser causes a heat exchange between the refrigerant and the outdoor air, so that the refrigerant radiates heat with respect to the outdoor air to be condensed.

The air conditioner also performs a heating operation. During the heating operation, the refrigerant is heated by the heating means. The heated refrigerant flows to the heat-use-side heat exchanger. In the heat-use-side heat exchanger, the refrigerant exchanges heat with the indoor air and radiates heat with respect to the indoor air, while the indoor air is heated.

In the air conditioner, the condenser only condenses the refrigerant during the cooling operation. Therefore, the condenser need not function as an evaporator, which is different from the outdoor heat exchanger of the conventional air conditioner. This renders the specifications of the condenser optimum for the condensation of the refrigerant through the heat exchange with the outdoor air and provides optimum operating conditions during the cooling operation.

In the air conditioner, on the other hand, the heating means only heats the refrigerant during the heating operation. This renders the specifications of the heating means optimum for the heating of the refrigerant and provides optimum conditions during the heating operation. Consequently, optimum operating conditions are provided during both of the cooling and heating operations, which improves energy efficiency.

Preferably, the heating means of the air conditioner heats the refrigerant by causing a heat exchange between combustion gas and the refrigerant. In the arrangement, the combustion gas exchanges heat with the refrigerant in the heating means, so that the refrigerant is heated.

Alternatively, the heating means of the air conditioner preferably heats the refrigerant by using latent heat of a heat medium heated and evaporated with combustion gas. In the arrangement, the combustion gas initially exchanges heat with the heat medium in the heating means so that the heat medium is heated and evaporated. Subsequently, the evaporated heat medium exchanges heat with the refrigerant so that the heat medium radiates heat with respect to the refrigerant and is condensed, while the refrigerant is heated.

Alternatively, the air conditioner according to the present invention comprises a refrigerant circuit having a refrigerant circulating through the inside thereof, the refrigerant circuit comprising a heat-use-side heat exchanger for causing a heat exchange between the refrigerant and indoor air and heating means heating means for heating said refrigerant by causing a heat exchange between combustion gas and said refrigerant.

Alternatively, the air conditioner according to the present invention comprises a refrigerant circuit having a refrigerant circulating through the inside thereof, the refrigerant circuit comprising a heat-use-side heat exchanger for causing a heat exchange between the refrigerant and indoor air and heating means for heating the refrigerant by using latent heat of a heat medium heated and evaporated with combustion gas.

When the air conditioner is in heating operation, the refrigerant is heated in the heating means. The heat refrigerant flows to the heat-use-side heat exchanger. In the heat-use-side heat exchanger, the refrigerant exchanges heat with the indoor air so that heat is radiated from the refrigerant to the indoor air, while the indoor heat is heated. In that case, the refrigerant is heated in the heating means through heat exchange with the combustion gas and through heat exchange with the heat medium heated and evaporated with combustion gas.

Here, it may also be considered that a heat exchange is caused between the refrigerant and warm water generated by heating water with the combustion gas in a boiler. In this case, the heat of the combustion gas is temporarily transferred to water and then transferred to the refrigerant so that the heating of the refrigerant is also performed by using the sensible heat change of the warm water. Consequently, the heat of the combustion gas in the boiler cannot satisfactorily be transferred to the refrigerant, resulting in lower energy efficiency.

By contrast, the air conditioner mentioned above heats the refrigerant through the heat exchange with the combustion gas or through the heat exchange with the vapor of the heat medium. Consequently, a heat loss during the transfer of heat from the combustion gas to the refrigerant can be reduced compared with the case where the refrigerant is heated via warm water, which ensures the transfer of heat from the combustion gas to the refrigerant. This achieves satisfactory transfer of heat from the combustion gas to the refrigerant and improves energy efficiency.

Preferably, the heating means of the air conditioner comprises a combustion element for causing a fuel to burn and generate combustion gas, a temperature adjusting element for cooling the combustion gas to a specified temperature or lower, and a heat exchanging element for causing a heat exchange between the combustion gas from the temperature adjusting element and the refrigerant in the refrigerant circuit.

In the air conditioner, the heating means comprises the combustion element, the temperature adjusting element, and the heat exchanging element. In the combustion element, such a fuel as natural gas, propane gas, or kerosene burns to generate the combustion gas, which flows from the combustion element to the temperature adjusting element. In the temperature adjusting element, the combustion gas is cooled to a specified temperature or lower. The combustion gas at a reduced temperature flows from the temperature adjusting element to the heat exchanging element. In the heat exchanging element, the combustion gas at a specified temperature or lower exchanges heat with the refrigerant so that the refrigerant is heated.

In the air conditioner, the combustion gas generated in the combustion element can be cooled to a specified temperature or lower in the temperature adjusting element and then supplied to the heat exchanging element. In short, the temperature of the combustion gas introduced into the heat exchanging element can preliminarily be reduced to a specified degree or lower. This allows a heat exchanger, which is superior in heat exchanging performance but inferior in heat resistance due to its structure, to be used as a heat exchanging element. As an example of this type of heat exchanger, there can be shown a multi-layer heat exchanger consisting of flat heat transmission plates and plate fins configured as corrugated sheets which are stacked in layers and joined together by brazing. The use of the excellent heat exchanging performance of this type of heat exchanger achieves reliable heating of the refrigerant with the combustion gas and further scaling down of the heat exchanging element.

Preferably, the temperature adjusting element of the air conditioner comprises a passage member having a hollow cylindrical configuration and defining an inner passage, the passage member having an inlet hole for introducing the combustion gas from the combustion element into the inner passage such that a flow of the combustion gas in the inner passage is disturbed and an outlet hole for supplying the combustion gas from the inner passage to the heat exchanging element; and a preheat tube wound around the passage member such that the refrigerant to be supplied to the heat exchanging element flows through the preheat tube.

In the air conditioner, the passage member and the preheat tube are provided in the temperature adjusting element. The passage member defines the inner passage. The combustion gas is introduced into the inner passage so that the flow of the combustion gas in the inner passage is disturbed. On the other hand, the refrigerant of the refrigerant circuit flows through the inside of the preheat tube wound around the passage member. In the temperature adjusting element, the refrigerant in the preheat tube absorbs heat, while the temperature of the combustion gas in the inner passage is reduced. The refrigerant that has absorbed heat in the preheat tube is then supplied to the heat exchanging element.

In the air conditioner, the refrigerant can be heated by using heat radiated from the combustion gas when the temperature of the combustion gas is reduced. This allows effective use of heat radiated from the combustion gas in the temperature adjusting element as heat for heating the refrigerant. This further achieves a reduction in the amount of heat applied to the refrigerant in the heat exchanging element and the scaling down of the heat exchanging element. Moreover, the flow of the combustion gas in the inner passage is disturbed. This promotes the radiation of heat from the combustion gas and achieves the scaling down of the temperature adjusting element.

Preferably, the heating means of the air conditioner comprises a boiler element for heating and evaporating the heat medium with the combustion gas and a vapor-liquid separating element for separating vapor of the heat medium generated in the boiler element, the heating means heating the refrigerant by causing a heat exchange between the vapor of the heat medium separated in the vapor-phase separating element and the refrigerant.

In the air conditioner, the heating means is provided with the boiler element and the vapor-liquid separating element. In the boiler element, the heat medium is heated with the combustion gas to reach a boiling state. In the vapor-liquid separating element, the heat medium evaporated in the boiler element, i.e., the vapor of the heat medium is separated. The heating means causes a heat exchange between the vapor of the heat medium separated in the vapor-liquid separating element and the refrigerant to heat the refrigerant. On the other hand, the heat medium that has radiated heat with respect to the refrigerant is condensed to return to the boiler element.

In the air conditioner, the vapor-liquid separating element is provided to separate the vapor of the heat medium to ensure the heat exchange between the vapor and the refrigerant. As a result, the latent heat of the vapor can be used positively for heating the refrigerant.

Preferably, the refrigerant circuit of the air conditioner is provided with a compressor having a variable capacity. In the air conditioner, the amount of refrigerant circulating through the refrigerant circuit can be adjusted by changing the capacity of the compressor. By adjusting the amount of refrigerant circulating through the refrigerant circuit, the air conditioning ability of the air conditioner can be adjusted. This enables an operation corresponding to an air conditioning load and enhances comfort.

Preferably, the air conditioner comprises an outdoor unit composed of the condenser accommodated in a casing and a refrigerant heating unit composed of the heating means accommodated in a casing. In the air conditioner, the outdoor unit and the refrigerant heating device are provided. The outdoor unit is structured similarly to the outdoor unit of a typical air conditioner which performs a refrigeration cycle. This allows the sharing of components between the air conditioner according to the present invention and the typical air conditioner, resulting in lower cost.

Preferably, the air conditioner comprises an indoor unit composed of the heat-use-side heat exchanger accommodated in a casing, the indoor unit supplying the air that has exchanged heat with the refrigerant in the heat-use-side heat exchanger into a room through a duct. In the air conditioner, the air that has exchanged heat with the refrigerant of the refrigerant circuit in the heat-use-side heat exchanger is then supplied to the room through the duct. With the air conditioner, the air from the indoor unit can be distributed in the room via the duct, which enables even air conditioning of the room.

DETAILED DESCRIPTION OF THE INVENTION

Figure 1:
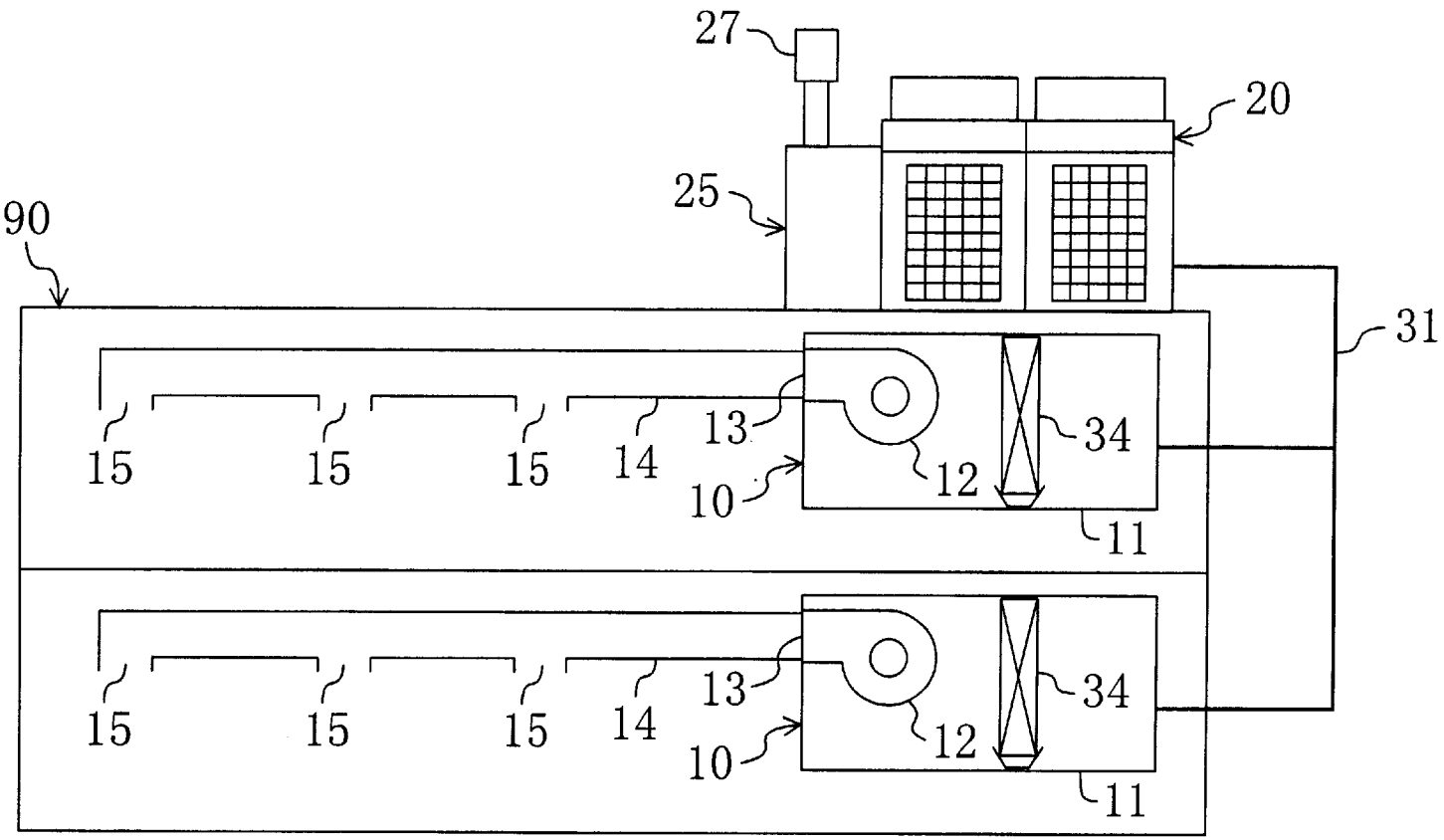
FIG. 1 is schematic structural view showing the placement of an air conditioner according to a first embodiment of the present invention.

Referring now to the drawings, the embodiments of the present invention will be described in detail.

EMBODIMENT 1

As shown in FIG. 1, an air conditioner according to the present embodiment comprises: an outdoor unit 20; a refrigerant heating unit 25; and indoor units 10. The outdoor unit 20 and the refrigerant heating unit 25 are placed on the rooftop of a building 90. On the other hand, the indoor units 10 are placed on the individual floors of the building 90. The outdoor unit 20 and the indoor units 10 are connected to each other via refrigerant piping 31.

Each of the indoor units 10 includes a casing 11, in which a plurality of indoor heat exchangers 34 as a heat-use-side heat exchanger and indoor fans 12 are accommodated. The casing 11 is formed with a suction hole (not shown) and a blow hole 13. The indoor air sucked in from the suction hole passes through the indoor heat exchanger 34 to be ejected from the blow hole 13. A duct 14 is connected to the blow hole 34 of the casing 11. The duct 14 is formed with a plurality of openings 15 so that the air ejected from the blow hole 13 of the indoor unit 10 is supplied into a room from the openings 15 of the duct 14.

Figure 2:
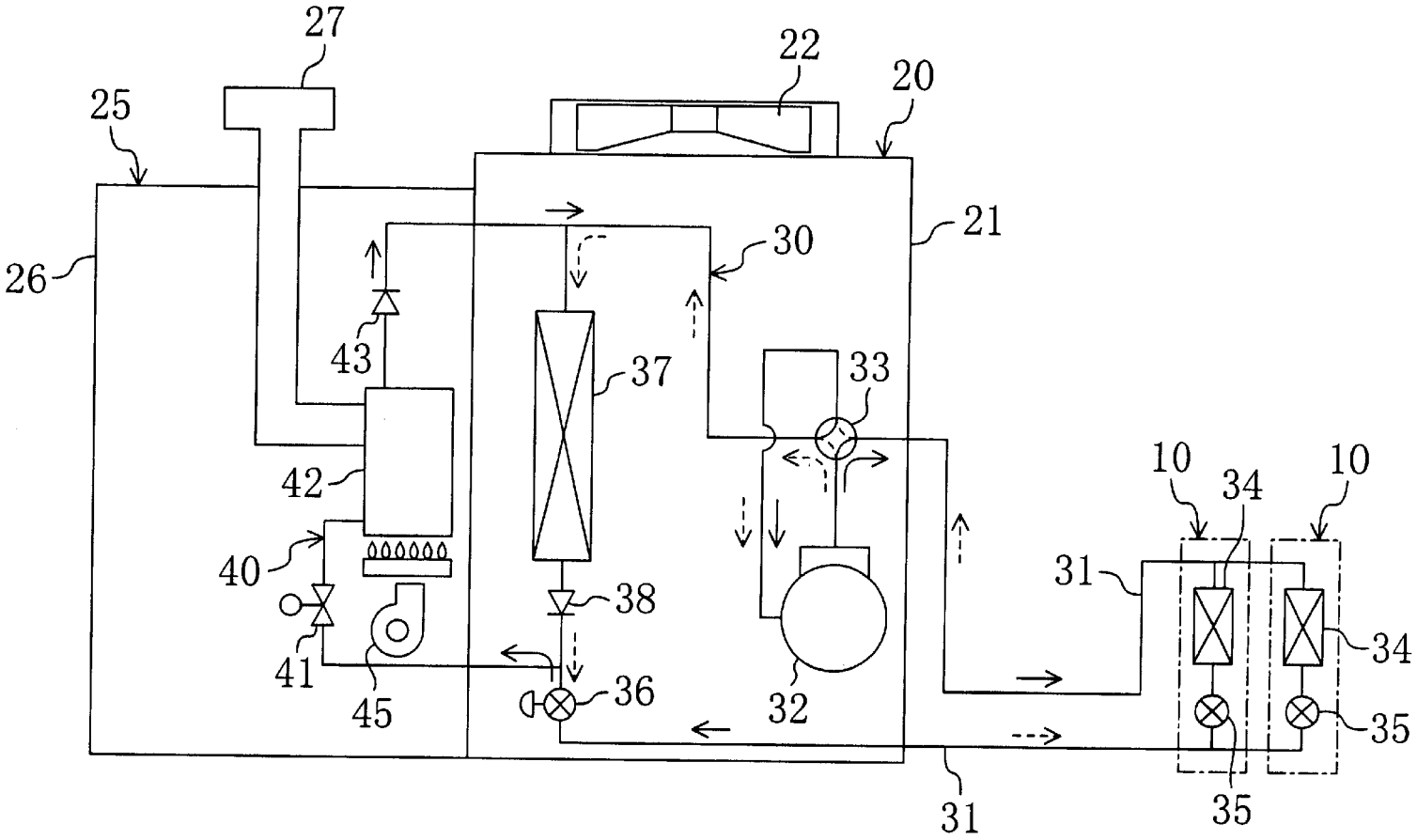
FIG. 2 is a schematic view showing a structure of a refrigerant circuit according to the first embodiment.

As shown in FIG. 2, the air conditioner has a refrigerant circuit 30, which is configured as a closed loop circuit having a compressor 32, an outdoor heat exchanger 37 as a condenser, or the like connected to each other with the refrigerant piping 31.

Specifically, each of the blowing side and sucking side of he compressor 32 is connected to a four-way switch valve 33. On he other hand, the four-way switch valve 33, the indoor heat exchangers 34, indoor electromotive valves 35, an outdoor electromotive valve 36, and the outdoor heat exchanger 37 are connected successively with the refrigerant piping 31. The refrigerant piping 31 extending from the outdoor heat exchanger 37 is connected to the four-way switch valve 33. The refrigerant circuit 30 reverses the direction of circulation of a refrigerant by switching the four-way switch valve 33.

The plurality of indoor heat exchangers 34 are connected in parallel to each other. The indoor electromotive valves 35 are provided to correspond to the individual indoor heat exchangers 34 on a one-by-one basis. On the other hand, a first check valve 38 is provided in the portion of the refrigerant piping 31 located between the outdoor electromotive valve 36 and the outdoor heat exchanger 37. The first check valve 38 permits only the passage of the refrigerant flowing from the outdoor heat exchanger 37 toward the outdoor electromotive valve 36.

The refrigerant circuit 30 is provided with a refrigerant heating circuit 40 composed of an electromagnetic valve 41, a refrigerant heater 42, and a second check valve 43 which are connected successively with the refrigerant piping 31. The refrigerant heating circuit 40 has one end closer to the electromagnetic valve 41 connected between the outdoor electromotive valve 36 and the first check valve 38 and the other end closer to the second check valve 43 connected between the outdoor heat exchanger 37 and the four-way switch valve 33. The second check valve 43 permits only the passage of the refrigerant flowing from the one end of the refrigerant heating circuit 40 to the other end thereof.

The compressor 32 is rotatively driven by a compressor motor, which is not shown. Electric power is supplied from a commercial power source to the compressor motor via an inverter. In that case, the power from the commercial power source is changed to an alternate current at a specified frequency by the inverter and supplied to the compressor motor. The number of revolutions of the compressor motor is changed by changing the frequency of the alternate current to be supplied, which renders the capacity of the compressor 32 variable.

Of the refrigerant circuit 30, the compressor 32, the four-way switch valve 33, the outdoor electromotive valve 36, the outdoor heat exchanger 37, and the first check valve 38 are accommodated in the casing 21 of the outdoor unit 20, while the electromagnetic valve 41, the refrigerant heater 42, and the second check valve 43 are accommodated in the casing 26 of the refrigerant heating unit 25. The indoor heat exchangers 34 and the indoor electromotive valves 35 are accommodated in the respective casings 11 of the indoor units.

The outdoor unit 20 is provided with an outdoor fan 22. The outdoor unit 20 sucks outdoor air into the casing 21 by means of the outdoor fan 22 such that the outdoor air passes through the outdoor heat exchanger 37.

Figure 3:
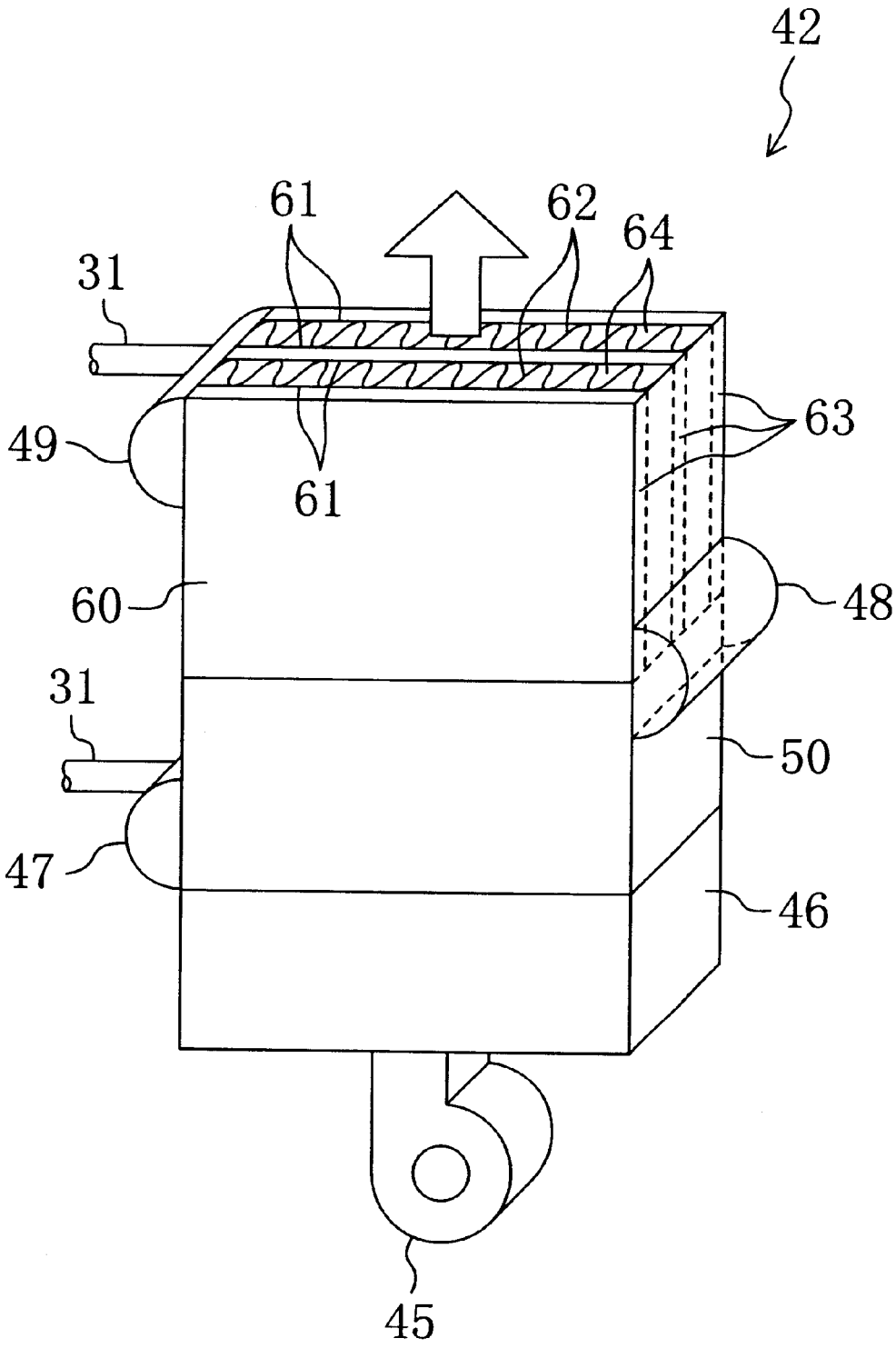
FIG. 3 is a schematic perspective view showing a structure of a refrigerant heater according to the first embodiment.

As shown in FIG. 3, the refrigerant heater 42 comprises a combustion element 46, a temperature adjusting element 50, and a heat exchanging element 60 to constitute heating means.

The combustion element 46 is provided with a Bunsen burner, which is not shown, and also with a combustion blower. The combustion element 46 causes natural gas as a fuel to burn in the burner and thereby generate combustion gas at a high temperature. As the fuel, there may also be used propane gas or kerosene.

Figure 4:
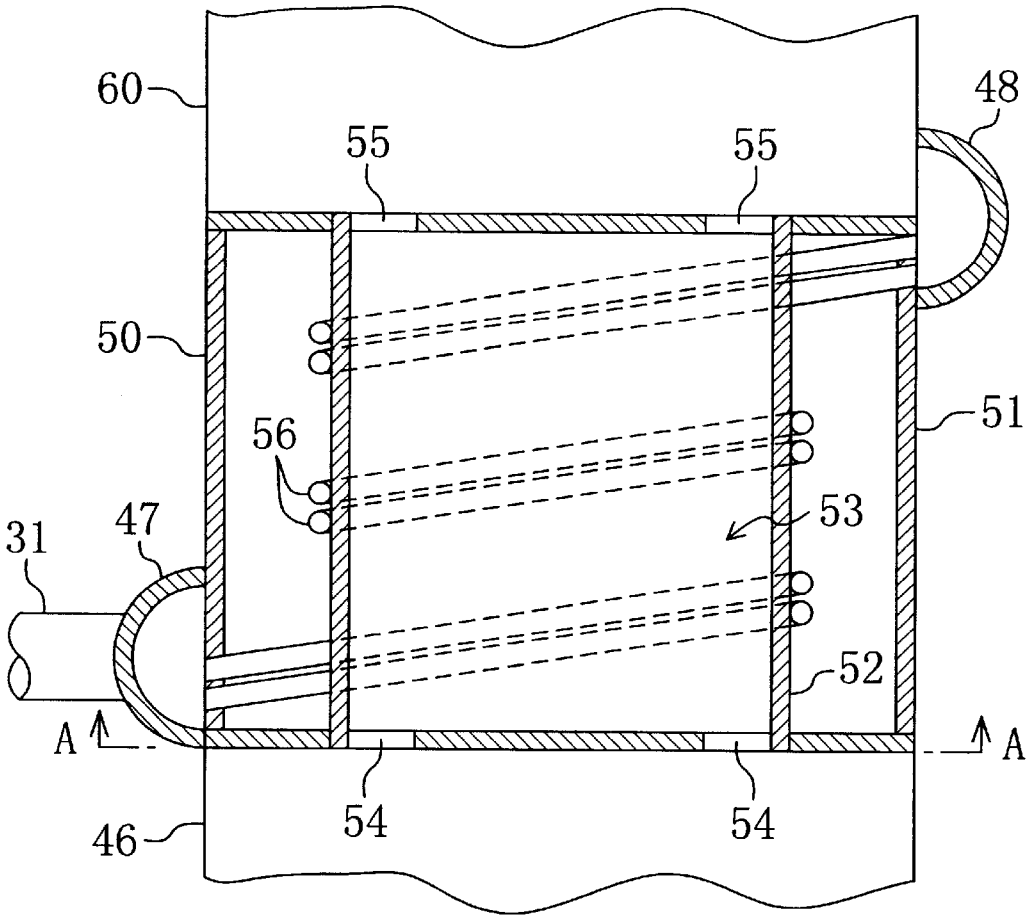
FIG. 4 is an enlarged view showing a structure of a temperature adjusting element according to the first embodiment.
Figure 5:
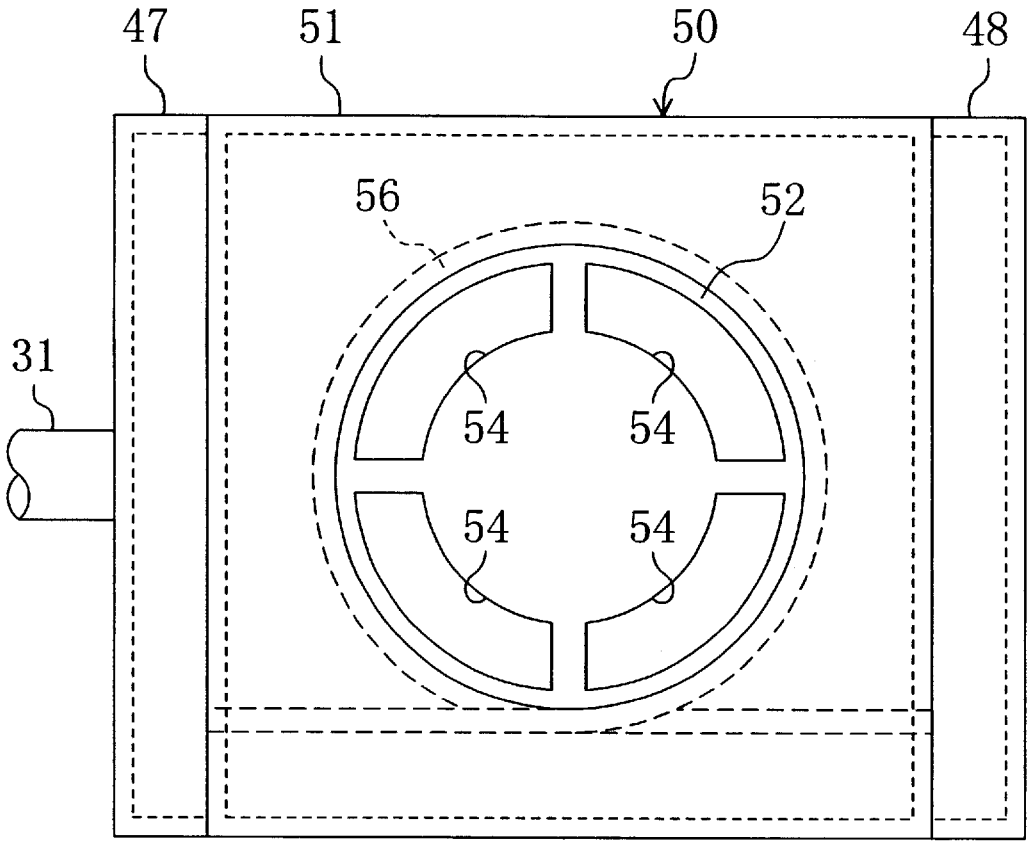
FIG. 5 is a cross-sectional view taken along the line A—A of FIG. 4.

The temperature adjusting element 50 is composed of an outer casing 51, a passage member 52, and preheat tubes 56, as shown in FIGS. 4 and 5. The outer casing 51 is configured as a hollow rectangular parallelepiped. The passage member 52 is provided within the outer casing 51.

The passage member 52 has a hollow cylindrical configuration and defines an inner passage 53. The passage member 52 is formed with inlet holes 54 and outlet holes 55. The inlet holes 54 are formed in the bottom face of the passage member 52 and circularly opened along the outer circumference of the inner passage 53. The inlet holes 54 are for introducing the combustion gas generated from the combustion element 46 into the inner passage 53. Since the inlet holes 54 have slightly small dimensions in the radial direction, the combustion gas passing through the inlet holes 54 is diffused in the inner passage 53, which disturbs the flow of the combustion gas in the inner passage 53. The outlet holes 55 are formed in the top face of the passage member 52 and circularly opened, similarly to the inlet holes 54. The outlet holes 55 are for supplying the combustion gas from the inner passage 53 to the heat exchanging element 60.

The outer casing 51 has a lower side face provided with a semi-cylindrical inlet header 47. The outer casing 51 has an upper side face provided with a semi-cylindrical middle header 48 which extends over to the lower side face of the heat exchanging element 60. On the other hand, the plurality of preheat tubes 56 are wound around the passage member 52. Each of the preheat tubs 56 has one end opened within the inlet header 47 and the other end opened within the middle header 48. The inlet header 47 is connected to the refrigerant piping 31 extending from the electromagnetic valve 41.

As shown in FIG. 3, the heat exchanging element 60 is composed of a multilayer heat exchanger consisting of a plurality of heating plates 61 and a plurality of plate fins 62 which are stacked in layers. Specifically, refrigerant passages 63 and combustion gas passages 64 are alternately formed between the individual heating plates 61 stacked in layers. The combustion gas passages 64 are provided with the individual plate fins 62 configured as corrugated sheets. The joining of the individual heating plates 61 to each other and the joining of the heating plates 61 to the plate fins 62 is achieved by brazing. The combustion gas passages 64 are connected to the inner passage 53 of the temperature adjusting element 50 such that the combustion gas flows from the inner passage 53 into the combustion gas passage 64.

The heat exchanging element 60 has an upper side face provided with a semi-cylindrical outlet header 49. The refrigerant passage 63 has a lower side face provided with a middle header 48. The refrigerant passage 63 is connected to each of the middle header 48 and the outlet header 49. The refrigerant flows from the preheat tubes 56 of the temperature adjusting element 50 into the refrigerant passage 63 via the middle header 48 and flows out of the outlet header 49 after exchanging heat with the combustion gas in the combustion gas passage 64.

The heat exchanging element 60 is formed integrally of the heating plates 61 and the plate fins 62 which are joined to each other by brazing. A brazing metal used for brazing has a comparatively low melting point on the order of, e.g., 800° C. On the other hand, the combustion gas obtained by causing natural gas to burn in the combustion element 46 has a high temperature on the order of 1200° C. If the combustion gas is introduced from the combustion element 46 directly into the heat exchanging element 60, therefore, the brazing metal melts to cause the destruction of the heat exchanging element 60. To prevent this, the present embodiment has provided the temperature adjusting element 50 between the combustion element 46 and the exchanging element 60 to introduce the combustion gas into the heat exchanging element 60 after reducing the temperature of the combustion gas in the combustion element 46 to the melting point of the brazing metal or lower.

A description will be given to the operations of the air conditioner with reference to the drawings.

During the heating operation, the four-way switch valve 33 is switched as indicated by the solid lines in FIG. 2 and the electromagnetic valve 41 is opened. On the other hand, the outdoor electromotive valve 36 is fully opened and each of the indoor electromotive valves 35 is adjusted to a predetermined degree of openness. In this state, the refrigerant flows through the refrigerant circuit 30 as indicated by the solid arrows in FIG. 2.

Specifically, the refrigerant ejected from the compressor 32 flows to the indoor heat exchangers 34 of the indoor units 10. At this time, the amounts of refrigerant distributed to the individual indoor heat exchangers 34 are adjusted by adjusting the degree of openness of each of the indoor electromotive valves 35. In the indoor units 10, the indoor fans 12 are driven so that the indoor air is sucked in the casings 11. In the indoor heat exchangers 34, a heat exchange is caused between the refrigerant from the compressor 32 and the indoor air so that the refrigerant is condensed by radiating heat, while the indoor air is heated. The air heated in each of the indoor heat exchangers 34 flows from the blow hole 13 into the duct 14 to be supplied from the openings 15 of the duct 14 into the room.

The refrigerant condensed in the indoor heat exchangers 34 sequentially passes through the indoor electromotive valves 35 and the outdoor electromotive valves 36 to flow into the refrigerant heating circuit 40. The refrigerant then passes through the electromagnetic valve 41 and flows into the inlet header 47 of the refrigerant heater 42.

In the combustion element 46 of the refrigerant heater 42, natural gas as a fuel is mixed with the air supplied from the combustion blower 45 to burn, thereby generating the combustion gas at a high temperature. The combustion gas flows from the inlet holes 54 of the passage member 52 into the inner passage 53. At this time, since the combustion gas flows into the inner passage 53 through the narrow inlet holes 54, the flow of the combustion gas in the inner passage 53 is disturbed. On the other hand, the refrigerant that has flown into the inlet header 47 is divided into streams and flows into the individual preheat tubes 56. While flowing through the inside of each preheat tube 56, the refrigerant exchanges heat with the combustion gas in the inner passage 53 so that the refrigerant is preheated and the temperature of the combustion gas is reduced. For example, the temperature of the combustion gas which is on the order of 1200° C. at the time at which the combustion gas flew from the combustion element 46 into the inner passage 53 is reduced to the order of 800° C. in the temperature adjusting element 50.

Thereafter, the refrigerant in the preheat tubes 56 passes through the middle header 48 to flow into the refrigerant passage 63 of the heat exchanging element 60, while the combustion gas in the inner passage 53 passes through the outlet holes 55 to flow into the combustion gas passage 64 of the heat exchanging element 60. In the heat exchanging element 60, the refrigerant in the refrigerant passage 63 exchanges heat with the combustion gas in the combustion gas passage 64. In that case, the plate fins 62 accelerate the transmission of heat from the combustion gas to the refrigerant. In the refrigerant passage 63, the refrigerant is heated and evaporated to form a gas refrigerant. The gas refrigerant passes through the outlet header 49 to flow from the refrigerant heater 42. In flowing out of the refrigerant heater 42, the temperature of the refrigerant is in the range of 40 to 45° C., while the temperature of the combustion gas is on the order of 160° C.

The gas refrigerant from the refrigerant heater 42 passes through the second check valve 43 and the four-way switch valve 33 to be sucked in by the compressor 32. The gas refrigerant gains a circulation driving force in the compressor 32 and flows again to the indoor heat exchangers 34 to repeat the circulation. In short, the air conditioner imparts the heat of the combustion gas to the refrigerant in the refrigerant heater 42 and transports the heat of the refrigerant to the indoor heat exchangers 34 through the circulation of the refrigerant, thereby heating the indoor airs.

It is sufficient for the compressor 32 to impart the circulation driving force to the gas refrigerant. The compressor 32 need not compress the gas refrigerant to a high pressure, which is different from the case where a heat pump cycle operation is performed. When the air conditioner is in the heating operation, therefore, the compressor 32 is operated at a comparatively low rpm with a low capacity.

During the cooling operation, the four-way switch valve 33 is switched as indicated by the broken lines in FIG. 2 and the electromagnetic valve 41 is closed. On the other hand, the outdoor electromotive valve 36 and the indoor electromotive valve 35 are adjusted to a predetermined degree of openness. In this state, the refrigerant flows through the refrigerant circuit 30, as indicated by the broken arrows in FIG. 2, to perform a refrigeration cycle operation.

Specifically, the refrigerant ejected from the compressor 32 flows to the outdoor heat exchanger 37. On the other hand, the outdoor fan 22 is rotatively driven in the outdoor unit such that the outdoor air is sucked in by the casing 21. In the outdoor heat exchanger 37, the refrigerant ejected from the compressor 32 exchanges heat with the outdoor air so that the refrigerant radiates heat and is condensed. The condensed liquid refrigerant is reduced in pressure in the outdoor electromotive valve 36 and then flows to the indoor heat exchangers 34. At this time, the amounts of refrigerant distributed to the individual indoor heat exchangers 34 are adjusted by adjusting the degree of openness of each of the indoor electromotive valves 35.

In the indoor units 10, the indoor fans 12 are driven so that the indoor air is sucked in by the casings 11. In each of the indoor heat exchangers 34, the refrigerant reduced in pressure in the outdoor electromotive valve 36 exchanges heat with the indoor air and absorbs heat to be evaporated, while the indoor air is cooled. The air cooled in the indoor heat exchanger 34 flows from the blow hole 13 into the duct 14 to be supplied from the openings 15 of the duct 14.

The refrigerant evaporated in the indoor heat exchanger 34 passes through the four-way switch valve 33 to be sucked in by the compressor 32. The refrigerant is compressed by the compressor 32 and flows again to the outdoor heat exchanger 37 to repeat the circulation.

In the first embodiment, the outdoor heat exchanger 37 only performs the condensation of the refrigerant during the cooling operation. Therefore, the outdoor heat exchanger 37 is required to function only as the condenser during the cooling operation and need not function as the evaporator during the heating operation. This allows the specifications of the outdoor heat exchanger 37 to be optimized as the condenser when the outdoor heat exchanger 37 is in the cooling operation and provides optimum operating conditions during the cooling operation. As a result, energy efficiency during the cooling operation can be improved.

In addition, the first embodiment heats the refrigerant by causing a direct heat exchange between the refrigerant and the combustion gas in the heat exchanging element 60 and temperature adjusting element 50 of the refrigerant heater 42. Compared with the case of heating the refrigerant via warm water, therefore, a heat loss during the transmission of heat from the combustion gas to the refrigerant can be reduced. This enables satisfactory transmission of heat from the combustion gas to the refrigerant and improves energy efficiency during the heating operation.

In the refrigerant heater 42, the combustion gas generated from the combustion element 46 is cooled to a specified temperature or lower in the temperature adjusting element 50 before it is supplied to the heat exchanging element 60. In short, the temperature of the combustion gas introduced into the heat exchanging element 60 can preliminarily be reduced to a specified degree or lower. As a result, the foregoing multi-layer heat exchanger, which is superior in heat exchanging performance but inferior in heat resistance due to its structure, can be used as the heat exchanging element 60. By using the excellent heat exchanging performance, the refrigerant can positively be heated with the combustion gas and the heat exchanging element 60 can further be scaled down.

In the heat adjusting element 50, the refrigerant is heated by using the heat radiated from the combustion gas when the temperature of the combustion gas is reduced. Accordingly, the heat radiated from the combustion gas in the temperature adjusting element 50 can be used effectively for heating the refrigerant, while the amount of heat applied to the refrigerant in the heat exchanging element 60 can be reduced, which also allows the scaling down of the heat exchanging element 60. Moreover, the flow of the combustion gas in the temperature adjusting element 50 is disturbed. This promotes the radiation of heat from the combustion gas and achieves the scaling down of the temperature adjusting element 50.

In addition, the present embodiment uses the compressor 32 having a variable capacity. Accordingly, the air-conditioning ability can be adjusted by adjusting the amount of refrigerant to be circulated through the refrigerant circuit 30. As a result, it becomes possible to perform an operation corresponding to an air-conditioning load and enhances comfort.

Furthermore, the outdoor unit 20 and the refrigerant heating unit 25 are provided in the present embodiment. The outdoor unit 20 is structured similarly to the outdoor unit of a typical air conditioner. This allows the sharing of components between the air conditioner according to the present embodiment and a typical air conditioner, resulting in lower cost.

EMBODIMENT 2

A second embodiment of the present invention has been achieved by modifying the structure of the refrigerant heater 42 of the first embodiment. The structure of the second embodiment is otherwise the same as that of the first embodiment. Below, a description will be given to the structure of the refrigerant heater 42.

Figure 6:
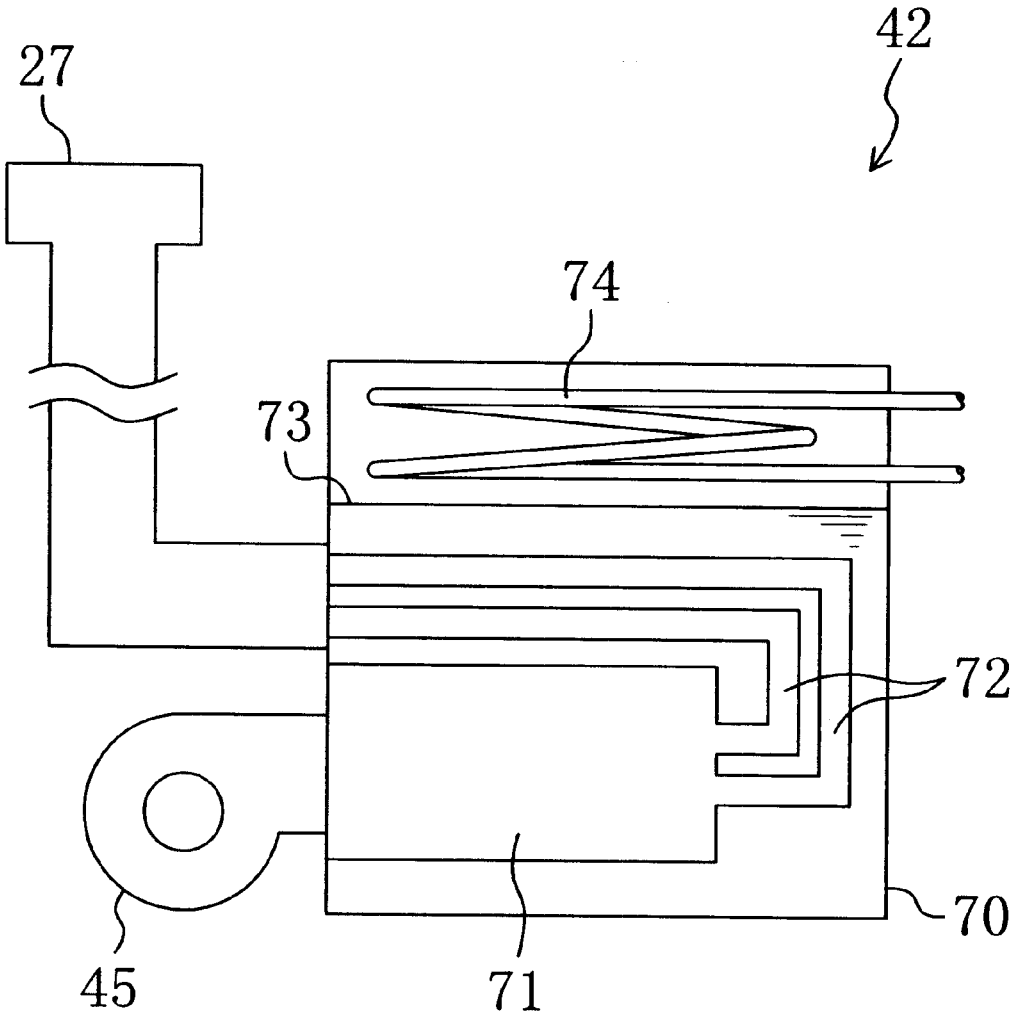
FIG. 6 is a schematic view showing a structure of a refrigerant heater according to a second embodiment of the present invention.

As shown in FIG. 6, the refrigerant heater 42 of the present embodiment is composed of: a boiler element 70; and a refrigerant heat tube 74.

The boiler element 70, which comprises a combustion chamber 71 and a plurality of smoke tubes 72, is structured similarly to a smoke tube boiler. The combustion chamber 71 is supplied with air by means of a combustion blower 45 and with natural gas as a fuel so that high-temperature combustion gas is generated through the burning of the natural gas. Each of the smoke tubes 72 has one end connected to the combustion chamber 71 and the other end connected to a funnel 27. The boiler element 70 causes a heat exchange between the combustion gas in the smoke tubes 72 and water as a heat medium such that water vapor is generated.

The refrigerant heat tube 72 is configured as a coil and connected to a refrigerant pipe 31 of a refrigerant heating circuit 40 to allow the refrigerant to pass through the inside thereof. The refrigerant heat tube 74 is disposed in a space at a level higher than a water face 73 within the boiler element 70.

During a cooling operation, the second embodiment performs the same operation as the first embodiment. During a heating operation also, the second embodiment performs the same operation as the first embodiment except for the operation of the refrigerant heater 42. Below, a description will be given to the operation of the refrigerant heater 42.

The combustion chamber 71 of the boiler element 70 is supplied with the air by means of the combustion blower 45 and with gas for combustion as a fuel. In the combustion chamber 71, natural gas burns to generate the high-temperature combustion gas. The combustion gas in the combustion chamber 71 is divided into streams and flows into the individual smoke tubes 72. The combustion gas exchanges heat with water while flowing through the inside of each smoke tube 72 so that water is heated to boil and generate water vapor. The combustion gas in the smoke tubes 72 is discharged through the funnel 27. The water vapor generated in the boiler element 70 exchanges heat with the refrigerant in the refrigerant heat tube 74. In the boiler element 70, the water vapor radiates heat to be condensed, while the refrigerant is heated to evaporate.

In the refrigerant heating element of the second embodiment, the refrigerant is heated with the water vapor generated through the heat exchange with the combustion gas. In other words, the refrigerant is heated by using the latent heat of the water vapor. Accordingly, the heat of the combustion gas can be transferred more positively to the refrigerant than in the case of heating the refrigerant by using the latent heat of the warm water. This achieves satisfactory transmission of heat from the combustion gas to the refrigerant and improves energy efficiency.

EMBODIMENT 3

A third embodiment of the present invention has been achieved by modifying the structure of the refrigerant heater 42 of the first embodiment. The structure of the third embodiment is otherwise the same as that of the first embodiment. Below, a description will be given to the structure of the refrigerant heater 42.

Figure 7:
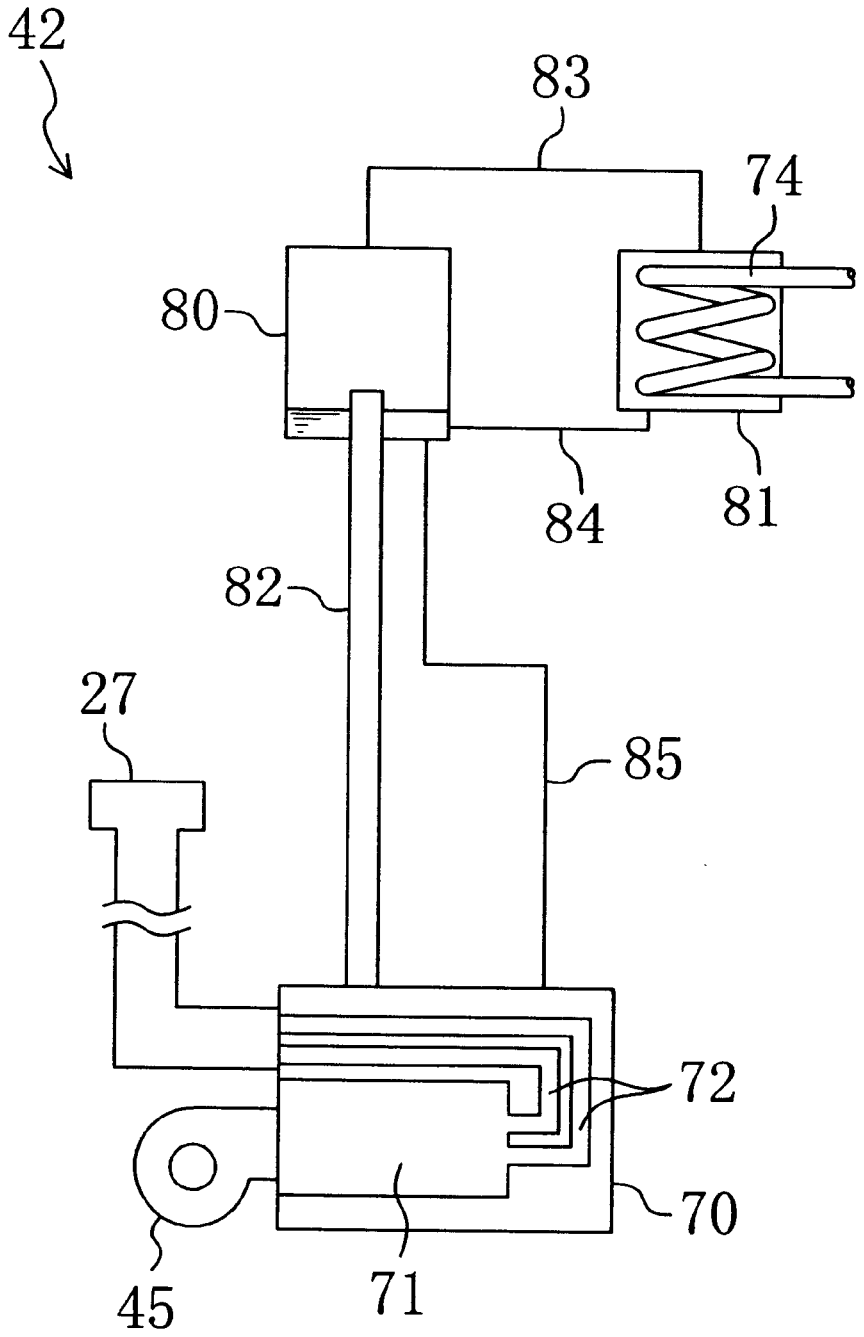
FIG. 7 is a schematic view showing a structure of a refrigerant heater according to a third embodiment of the present invention.
Figure 8:
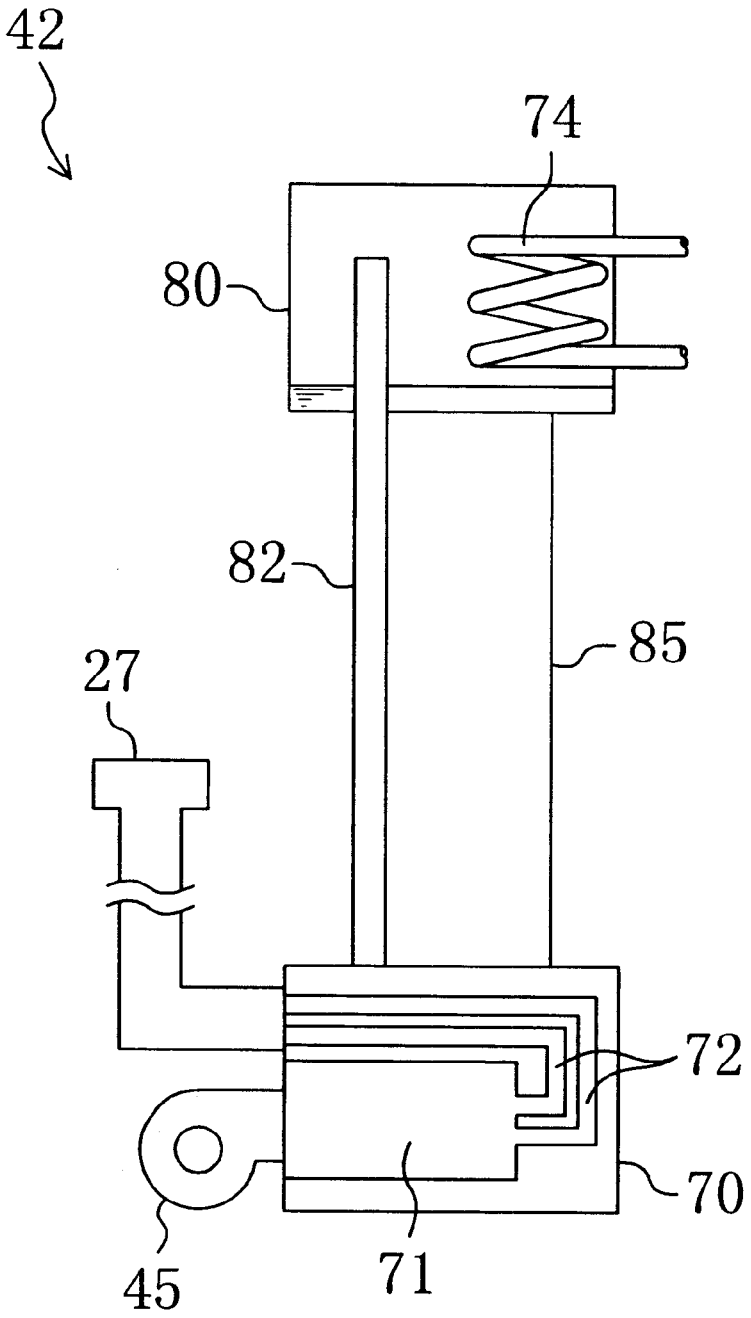
FIG. 8 is a schematic view showing a structure of a refrigerant heater according to a variation of the third embodiment.

As shown in FIG. 7, the refrigerant heater 42 of the present embodiment is composed of: a boiler element 70; a vapor-liquid separating element 80; and a condensation vessel 81.

The boiler element 70 comprising the combustion chamber 71 and the plurality of smoke tubes 72 are structured as a smoke tube boiler, similarly to the second embodiment. The third embodiment is also similar to the second embodiment in that the boiler element 70 is provided with the combustion blower 45 and the funnel 27.

The vapor-liquid separating element 80 is configured as a cylindrical vessel and located above the boiler element 70. The lower portion of the vapor-liquid separating element 80 and the upper portion of the boiler element 70 are connected to a vapor-liquid tube 82 with a large diameter and a return tube 85 with a small diameter, respectively. The vapor-liquid tube 82 has an upper end protruding into the vapor-liquid separating element 80.

The condensation vessel 81 is configured as a cylindrical vessel and located on one side of the vapor-liquid separating element 80. The upper portion of the condensation vessel 81 and the upper portion of the vapor-liquid separating element 80 are connected to a vapor tube 83. The lower portion of the condensation vessel 81 and the lower portion of the vapor-liquid separating element 80 are connected to a liquid tube 84. A refrigerant heat tube 74 is accommodated in the condensation vessel 81. The refrigerant heat tube 74 is configured as a coil and connected to the refrigerant piping 31 of the refrigerant heating circuit 40 such that the refrigerant passes through the inside of the refrigerant heat tube 74.

During a cooling operation, the present embodiment performs the same operation as the first embodiment. During a heating operation also, the present embodiment performs the same operation as the first embodiment except for the operation of the refrigerant heater 42. Below, a description will be given to the operation of the refrigerant heater 42.

The combustion chamber 71 of the boiler element 70 is supplied with the air from the combustion blower 45 and with gas for combustion as a fuel. In the combustion chamber 71, natural gas burns to generate high-temperature combustion gas. The combustion gas in the combustion chamber 71 is divided into streams and flows into the individual smoke tubes 72. The combustion gas exchanges heat with water, while flowing through the inside of the smoke tubes 72, so that water is heated to boil and generate water vapor. Thereafter, the combustion gas in the smoke tubes 72 is discharged through the funnel 27.

In the boiler element 70, water is in a boiling state and flows through the vapor-liquid tube 82 with its vapor phase and liquid phase being mixed with each other, to be ejected into the vapor-liquid separating element 80. In the vapor-liquid separating element 80, the liquid phase of the ejected water is accumulated in the lower portion of the vapor-liquid separating element 80, while the vapor phase thereof, i.e., water vapor passes through the vapor tube 83 to flow into the condensation vessel 81. In the condensation vessel 81, the vapor exchanges heat with the refrigerant in the refrigerant heat tube 74. In the condensation vessel 81, the water vapor radiates heat to be condensed, while the refrigerant is heated to evaporate. The water condensed in the condensation vessel 81 passes through the liquid tube 84 to temporarily flow into the vapor-liquid separating element 80 and then passes through the return tube 85, together with the water in the vapor-liquid separating element 80, to flow into the boiler element 70.

Thus, the present embodiment achieves the same effect as achieved by the second embodiment.

In present embodiment, there are provided the vapor-liquid separating element 80 and the condensation vessel 81 which is internally provided with the refrigerant heat tube 74. However, it is also possible to provide the refrigerant heat tube 74 within the vapor-liquid separating element 80 without providing the condensation vessel 81.

The present invention can be embodied in various other forms without departing from the spirit or essential characteristics thereof.

For instance, the fuel burned in the refrigerant heater 42 is not limited to natural gas, though each of the foregoing embodiment has caused natural gas to burn in the refrigerant heater 42 such that the refrigerant is heated by using the heat of the combustion gas obtained. Instead of natural gas, propane gas, kerosene, or the like may also be used as a fuel.

Thus, the foregoing embodiments are in every respect illustrative and not restrictive and therefore should not be construed restrictively. The scope of the present invention is defined by the appended claims and is by no means limited by the description of the specification. Further, all changes and modifications that fall within equivalent meets and bounds of the claims are embraced in the scope of the present invention.

What is claimed is:

1. An air conditioner comprising a refrigerant-circulating circuit having a refrigerant circulating through the inside thereof, said refrigerant-circulating circuit comprising:

a heat-use-side heat exchanger for causing a heat exchange between said refrigerant and indoor air;

a condenser only for condensing said refrigerant by causing a heat exchange between said refrigerant and outdoor air; and heating means only for heating said refrigerant, said heating means comprising a combustion element for causing a fuel to burn and generate the combustion gas;

a temperature adjusting element for cooling said combustion gas to a specified temperature or lower, and a heat exchanging element for causing a heat exchange between said combustion gas from said temperature adjusting element and said refrigerant in said refrigerant-circulating circuit; and said temperature adjusting element comprising a passage member having a hollow cylindrical configuration and defining an inner passage, said passage member having an inlet hole for introducing said combustion gas from said combustion element into said inner passage such that a flow of said combustion gas in said inner passage is disturbed and an outlet hole for supplying said combustion gas from said inner passage to said heat exchanging element, and a preheat tube wound around said passage member in such manner that said refrigerant to be supplied to said heat exchanging element flows through the preheat tube;

wherein said heating means heats said refrigerant by causing a heat exchange between combustion gas and said refrigerant.

2. An air conditioner comprising a refrigerant-circulating circuit having a refrigerant circulating through the inside thereof, said refrigerant-circulating circuit comprising:

a heat-use-side heat exchanger for causing a heat exchange between said refrigerant and indoor air; and heating means for heating said refrigerant by causing a heat exchange between combustion gas and said refrigerant; said heating means comprising a combustion element for causing a fuel to burn and generate the combustion gas;

a temperature adjusting element for cooling said combustion gas to a specified temperature or lower, and a heat exchanging element for causing a heat exchange between said combustion gas from said temperature adjusting element and said refrigerant in said refrigerant-circulating circuit; and said temperature adjusting element comprising a passage member having a hollow cylindrical configuration and defining an inner passage, said passage member having an inlet hole for introducing said combustion gas from said combustion element into said inner passage such that a flow of said combustion gas in said inner passage is disturbed and an outlet hole for supplying said combustion gas from said inner passage to said heat exchanging element, and a preheat tube wound around said passage member in such manner that said refrigerant to be supplied to said heat exchanging element flows through the preheat tube.

* * * * *